US009666116B2

(12) United States Patent
Jung et al.

(10) Patent No.: US 9,666,116 B2
(45) Date of Patent: May 30, 2017

(54) IMAGE DISPLAY DEVICE AND DRIVING METHOD THEREOF

(71) Applicant: SAMSUNG DISPLAY CO., LTD., Yongin, Gyeonggi-Do (KR)

(72) Inventors: Hae-Goo Jung, Yongin (KR); Do-Hyung Ryu, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 13 days.

(21) Appl. No.: 14/471,187

(22) Filed: Aug. 28, 2014

(65) Prior Publication Data

US 2015/0062197 A1 Mar. 5, 2015

(30) Foreign Application Priority Data

Sep. 5, 2013 (KR) ..... 10-2013-0106405

(51) Int. Cl.
*G09G 5/10* (2006.01)
*G09G 3/20* (2006.01)
*G09G 3/36* (2006.01)

(52) U.S. Cl.
CPC ..... *G09G 3/2003* (2013.01); *G09G 3/3607* (2013.01); *G09G 2320/046* (2013.01); *G09G 2320/103* (2013.01); *G09G 2360/16* (2013.01)

(58) Field of Classification Search
CPC ..... G09G 3/2003; G09G 3/3607; G09G 2310/027; G09G 2320/0666; G09G 2320/046; G09G 2320/103; G09G 2360/16; G06T 11/001
See application file for complete search history.

(56) References Cited

U.S. PATENT DOCUMENTS 9,418,591 B2 * 8/2016 Kim ..... G09G 3/3225
2002/0130892 A1 * 9/2002 Holtslag ..... H04N 5/144 345/690
2007/0080915 A1 * 4/2007 Nomizo ..... G09G 3/3648 345/89
2008/0106544 A1 * 5/2008 Lee ..... G09G 3/3611 345/214

(Continued)

FOREIGN PATENT DOCUMENTS

KR 2002-0067926 A 8/2002
KR 10-2004-0019747 A 3/2004
KR 10-2004-0063567 A 7/2004

(Continued)

*Primary Examiner* — Towfiq Elahi
(74) *Attorney, Agent, or Firm* — Lee & Morse P.C.

(57) ABSTRACT

An image display device includes a plurality of pixels, a pixel detection unit configured to detect first pixels having same R, G, and B gray scale values for a predetermined time among the plurality of pixels, a gray scale value calculation unit configured to calculate average gray scale values of the first pixels and average gray scale values of corresponding R, G and B of second pixels in a predetermined area around the first pixels, a data correction unit configured to correct the R, G and B gray scale values of the first pixels, using the calculated average gray scale values of the first and second pixels, and a data driver configured to correct the image data with the corrected R, G and B gray scale values of the first pixels, and to supply the corrected image data to each pixel of the plurality of pixels.

8 Claims, 3 Drawing Sheets

(56) References Cited

U.S. PATENT DOCUMENTS

2008/0304087 A1* 12/2008 Shin ..... G06T 5/009
358/1.6
2013/0169663 A1* 7/2013 Seong ..... G09G 5/00
345/589

FOREIGN PATENT DOCUMENTS

KR 10-2007-0014693 A 2/2007
KR 10-2012-0075805 A 7/2012

* cited by examiner

IMAGE DISPLAY DEVICE AND DRIVING METHOD THEREOF

CROSS-REFERENCE TO RELATED APPLICATION

Korean Patent Application No. 10-2013-0106405, filed on Sep. 5, 2013, in the Korean Intellectual Property Office, and entitled: "Image Display Device and Driving Method Thereof," is incorporated by reference herein in its entirety.

BACKGROUND

1. Field

An aspect of the present disclosure relates to an image display device and a driving method thereof.

2. Description of the Related Art

Recently, there have been developed various types of image display devices capable of reducing the weight and volume of cathode ray tubes. Such image display devices include, e.g., a liquid crystal display (LCD) device, a field emission display (FED) device, a plasma display panel (PDP), an organic light emitting diode (OLED) display device, and the like.

SUMMARY

According to an aspect of the present disclosure, there is provided an image display device, a plurality of pixels, a pixel detection unit configured to detect first pixels having same R, G, and B gray scale values for a predetermined time or more among the plurality of pixels, using an image data supplied from an outside source of the image display device, a gray scale value calculation unit configured to calculate average gray scale values of the respective R, G and B of the first pixels and average gray scale values of corresponding R, G and B of second pixels, the second pixels being included in a predetermined area around the first pixels, using the image data, a data correction unit configured to correct the R, G and B gray scale values of the first pixels included in the image data, using the calculated average gray scale values of the respective R, G and B of the first pixels and the average gray scale values of the corresponding R, G and B of the second pixels, and a data driver configured to receive the corrected R, G and B gray scale values of the first pixels, to generate corrected image data with the corrected R, G and B gray scale values of the first pixels, and to supply the corrected image data to each pixel of the plurality of pixels.

The data correction unit may generate a scaling variable, using the average gray scale values of the respective R, G and B of the first pixels and the average gray scale values of the respective R, G and B of the second pixels, and correct the R, G and B gray scale values of the first pixels by multiplying the R, G and B gray scale values of the first pixels by the scaling variable.

The data correction unit may calculate difference between the average gray scale values of the respective R, G and B of the first pixels and the average gray scale values of the respective R, G and B of the second pixels, and generate the scaling variable, using the positive maximum or minimum value among the differences between the gray scale values of the respective R, G and B.

The scaling variable may mean a value obtained by dividing the maximum or minimum value by an average gray scale value corresponding to the maximum or minimum value among the average gray scale values of the respective R, G and B of the first pixels.

The data correction unit may correct the R, G and B gray scale values of the first pixels as complementary colors of the average gray scale values of the respective R, G and B of the second pixels.

The data correction unit may correct the R, G and B gray scale values of the first pixels when a predetermined time is changed or when at least one of the average gray scale values of the R, G and B of the second pixels is changed.

The pixel detection unit may detect the first pixels with respect to an image data supplied to pixels included in a corner area among the plurality of pixels.

According to another aspect, there is provided a method of driving an image display device, the method including: detecting first pixels having the same R, G and B gray scale values for a predetermined time or more among a plurality of pixels, using an image data supplied from the outside of the image display device; calculating average gray scale values of the respective R, G and B of the first pixels, using the image data; calculating average gray scale values of the respective R, G and B of second pixels included in a predetermined area around the first pixels; correcting the R, G and B gray scale values of the first pixels included in the image data, using the average gray scale values of the respective R, G and B of the first pixels and the average gray scale values of the respective R, G and B of the second pixels; and receiving the corrected image data and supplying the received image data to each pixel.

In the detecting of the first pixels, the first pixels may be detected with respect to an image data supplied to pixels included in a corner area among the plurality of pixels.

The correcting may include generating a scaling variable, using the average gray scale values of the respective R, G and B of the first pixels and the average gray scale values of the respective R, G and B of the second pixels; and correcting the R, G and B gray scale values of the first pixels by multiplying the R, G and B gray scale values of the first pixels by the scaling variable.

The generating of the scaling variable may include calculating differences between the average gray scale values of the respective R, G and B of the first pixels and the average gray scale values of the respective R, G and B of the second pixels; and generating the scaling variable, using the positive maximum or minimum value among the differences between the gray scale values of the respective R, G and B.

The scaling variable may mean a value obtained by dividing the maximum or minimum value by an average gray scale value corresponding to the maximum or minimum value among the average gray scale values of the respective R, G and B of the first pixels.

In the correcting, the R, G and B gray scale values of the first pixels may be corrected when a predetermined time is changed or when at least one of the average gray scale values of the R, G and B of the second pixels is changed.

BRIEF DESCRIPTION OF THE DRAWINGS

Features will become apparent to those of ordinary skill in the art by describing in detail exemplary embodiments with reference to the attached drawings, in which.

DETAILED DESCRIPTION

Figure 1:
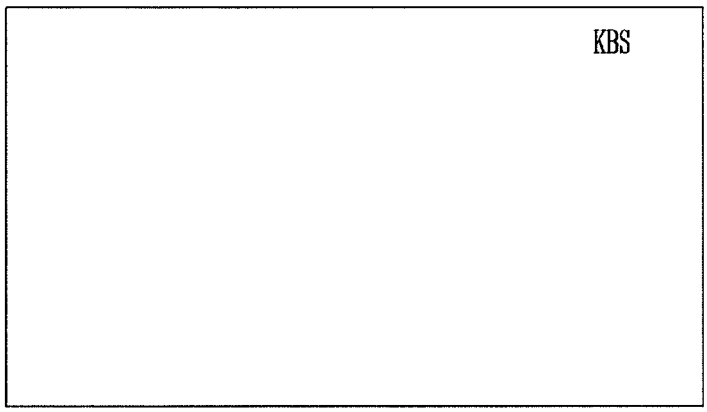
FIG. 1 illustrates a diagram of an example of a logo displayed in an image display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Also, when a first element is described as being coupled to a second element, the first element may be not only directly coupled to the second element but may also be indirectly coupled to the second element via a third element. Further, some of the elements that are not essential to the complete understanding of the disclosure are omitted for clarity. Also, like reference numerals refer to like elements throughout.

If a still image is displayed for a long period of time on a TV using an image display device, a fluorescent substance is burned. Therefore, although another image is displayed, the still image may be left as an afterimage on a screen.

For example, in a case where a logo, e.g., a name of a broadcasting station, is displayed on an image screen as shown in FIG. 1, the logo may be left as an afterimage on the screen when a long period of time elapses, thereby causing inconveniences during TV watching. In case of the logo, the same R, G and B are continuously output at the same position, so degradation of pixels occurs at the corresponding position. While attempts were made to prevent such an afterimage by moving the logo, the movement of the logo may be easily recognized by a user.

Figure 2:
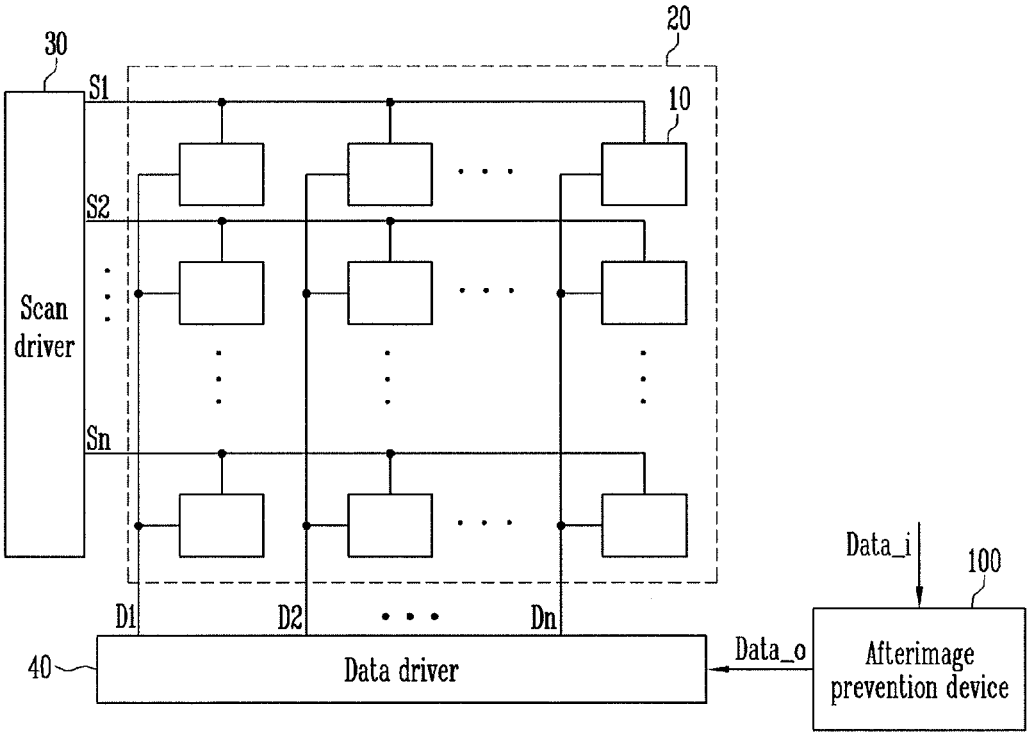
FIG. 2 illustrates a diagram of an image display device according to an embodiment.

FIG. 2 illustrates a diagram of an image display device according to an embodiment.

Referring to FIG. 2, the image display device according to this embodiment may include a pixel unit 20, a scan driver 30, a data driver 40, and an afterimage prevention device 100.

The pixel unit 20 may include a plurality of pixels 10 disposed in a matrix type at intersection portions of scan lines S1 to Sn and data lines D1 to Dm. The pixel unit 20 is driven by receiving driving power sources such as a high-potential pixel power source ELVDD and a low-potential pixel power source ELVSS from an outside (e.g., a power supply unit).

Each pixel 10 constituting the pixel unit 20 stores a data signal supplied from a data line D coupled thereto when a scan signal is supplied from a scan line S coupled thereto, and emits light with a luminance corresponding to the data signal. Accordingly, an image corresponding to the data signal is displayed in the pixel unit 10.

The scan driver 20 progressively generates a scan signal, corresponding to a scan control signal supplied from an outside (e.g., a timing controller). The scan signal generated in the scan driver 20 is supplied to the scan lines S1 to Sn.

The data driver 30 generates a data signal, using an image data Data_o transmitted from the afterimage prevention device 100. The data signal generated in the data driver 30 is supplied to the pixels 10 through the data lines D1 to Dm to be synchronized with the scan signal.

The afterimage prevention device 100 detects pixels corresponding to a still sub-image, e.g., a logo, included in a displayed image, using an image data Data_i supplied from an outside thereof, and corrects R, G and B gray scale values of the pixels corresponding to the logo included in the image data Data_i, using R, G and B gray scale values of pixels positioned in an area around the logo in order to prevent the occurrence of an afterimage. Then, the afterimage prevention device 100 transmits the corrected image data Data_o to the data driver 30.

In a conventional image display device where a logo having the same R, G and B gray scale values is displayed at a specific position of an image for a certain period of time, pixels corresponding to the logo may be degraded, and an afterimage may occur at the specific position of the logo. Thus, the present embodiment discloses an image display device which can prevent the degradation of pixels and the occurrence of an afterimage by transmitting, to the data driver 30, the image data Data_o in which the R, G and B gray scale values corresponding to the logo are corrected, while minimizing the user's recognition. The image prevention device 100 performing the function described above will be described in detail with reference to FIG. 3.

Figure 3:
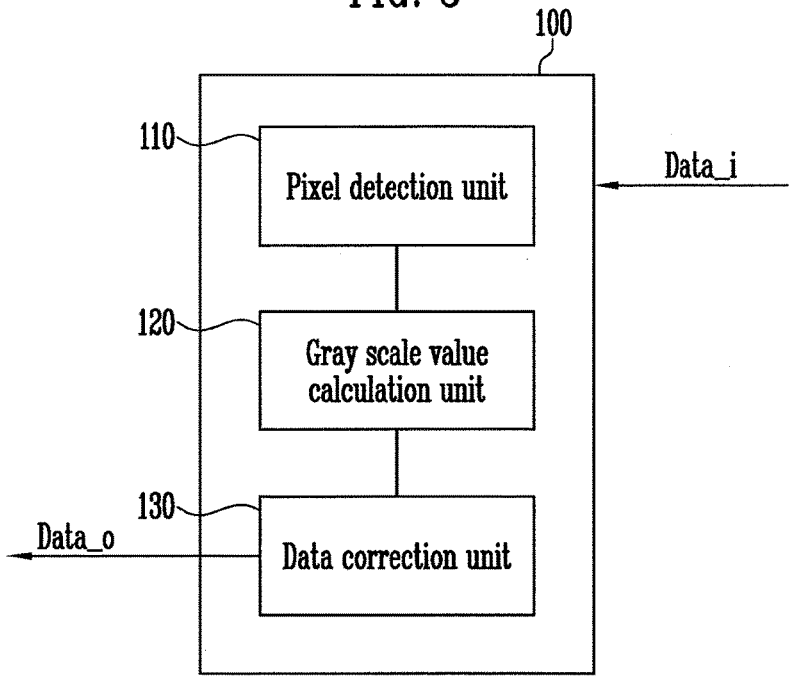
FIG. 3 illustrates a block diagram of an afterimage prevention device according to an embodiment.

FIG. 3 illustrates a block diagram of an afterimage prevention device according to an embodiment.

Referring to FIG. 3, the afterimage prevention device 100 may include a pixel detection unit 110, a gray scale value calculation unit 120, and a data correction unit 130.

An image displayed in the image display device is configured with pixels, and each pixel has R, G, and B gray scale values. The image data Data_i supplied to the afterimage prevention device 100 includes information on the R, G, and B gray scale values of each pixel.

The pixel detection unit 110 detects first pixels at the position where a logo is displayed among the pixels 10, using the image data Data_i supplied from the outside of the afterimage prevention device 100.

For example, in a case where the color of a logo, e.g., a displayed character 'K', is purple, each purple pixel has three R, G and B gray scale values corresponding to three sub-pixels, and each of the R, G and B sub-pixels in each purple pixel emits light with the same gray scale for a predetermined time or more in order to express the purple color of the logo. Thus, the pixel detection unit 110 determines the first pixels as pixels having the same R, G and B gray scale values for the predetermined time or more, using the image data Data_i, thereby detecting the pixels corresponding to, e.g., displaying, the logo.

Generally, the areas in which logos can be detected may be corner areas of the screen. Therefore, according to an embodiment, the pixel detection unit 110 may detect the first pixels corresponding to the logo with respect to the image data Data_i supplied to pixels included in corner areas of the screen among all the pixels 10.

The gray scale value calculation unit 120 calculates average gray scale values of the respective R, G and B of the first pixels and average gray scale values of the respective R, G and B of second pixels included in a predetermined area around the first pixels, using the image data Data_i. For example, the gray scale value calculation unit 120 may set a predetermined block, e.g., area, around the first pixels, and may calculate an average gray scale value of the respective R, G and B of the second pixels in the predetermined block, except the first pixels included in the block, as will be described in more detail below with reference to FIG. 4. The size of the block may be set in consideration of an interval between logo characters, etc.

Figure 4:
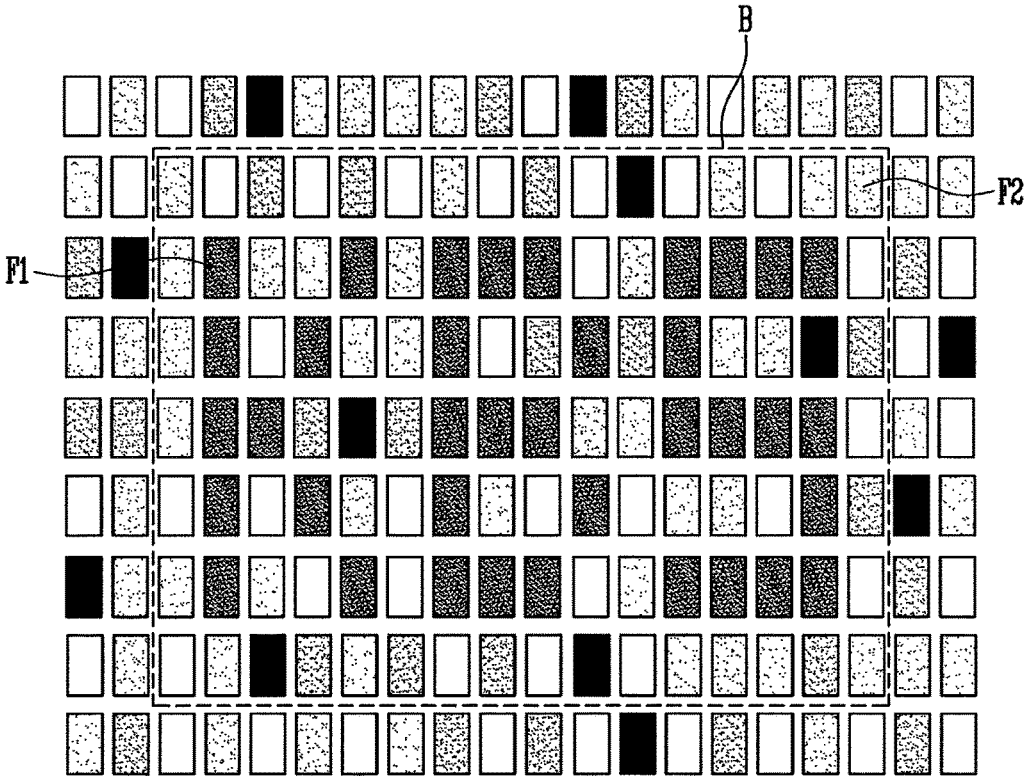
FIG. 4 illustrates a diagram of some pixel areas including a logo according to an embodiment.

FIG. 4 illustrates a diagram of some pixel areas including a logo according to an embodiment. In FIG. 4, a plurality of pixels 10 are arranged in a matrix pattern to illustrate an enlarged portion of the screen of FIG. 1 including the logo 'KBS'.

Referring to FIG. 4, it can be seen that the logo "KBS" is displayed by first pixels F1 of the plurality of pixels 10. The first pixels F1 have, e.g., exhibit, the same R, G and B gray scale values for a predetermined period of time. The gray scale value calculation unit 120 sets a predetermined block B around the first pixels F1 (dashed line), and calculates the average gray scale values of the respective R, G and B of second pixels F2 in the block B, i.e., pixels in block B other than the first pixels F1.

Referring back to FIG. 3, the data correction unit 130 corrects the R, G and B gray scale values of the first pixels included in the image data Data_i, using the average gray scale values of the respective R, G and B of the first pixels and the average gray scale values of the respective R, G and B of the second pixels. In detail, the data correction unit 130 generates a scaling variable, using the average gray scale values of the respective R, G and B of the first pixels and the average gray scale values of the respective R, G and B of the second pixels, and performs a data scaling operation of multiplying the R, G and B gray scales of the first pixels by the scaling variable, thereby correcting the R, G and B gray scale values of the first pixels.

In order to generate the scaling variable, the data correction unit 130 calculates differences between the average gray scale values of the respective R, G and B of the first pixels and the average gray scale values of the respective R, G and B of the second pixels, and selects a positive maximum value among the differences between the gray scale values of the respective R, G and B. Subsequently, the data correction unit 130 generates the scaling variable by dividing the selected positive maximum value by an average gray scale value corresponding to a maximum value among the average gray scale values of the respective R, G and B of the first pixels. The scaling variable may be expressed as shown in the following Equation 1.

$$s = \frac{g_{max}}{L_g} \qquad \text{Equation 1}$$

In Equation 1 above, "s" denotes a scaling variable, "$g_{max}$" denotes the positive maximum value among the differences between the average gray scale values of the respective R, G and B of the first pixels and the average gray scale values of the respective R, G and B of the second pixels, and "$L_g$" denotes any one gray scale value among the average gray scale values of the respective R, G and B of the first pixels, corresponding to the maximum value.

For example, when the average gray scale values of the respective R, G and B of the first pixels are (180, 150, 250) and the average gray scale values of the respective R, G and B of the second pixels are (100, 150, 200), the differences between the average gray scale values of the respective R, G and B of the first pixels and the average gray scale values of the respective R, G and B of the second pixels are calculated by subtracting corresponding values. Therefore, the differences between the exemplary average gray scale values of the first and second pixels above are (80, −100, 50), i.e., (180-100, 50-150, 250-200). In this case, the positive maximum value, i.e., $g_{max}$, out of the positive differences between the gray scale values is 80, and the maximum value among the average gray scale values of the first pixels is 180. Thus, the scaling variable is generated as (s=80/180=0.44) obtained by dividing 80 by 180, which the average gray scale value of R of the first pixels, corresponding to 80.

Subsequently, the data correction unit 130 corrects the R, G and B gray scale values of the first pixels as (79.2, 66, 88) by multiplying the average gray scale values (180, 150, 200) of the respective R, G and B of the first pixels by the scaling variable of 0.44. The R, G and B gray scale values of the first pixels are decreased through the correction described above, so that the luminance of the first pixels is lowered.

The reason why a negative value is excluded from the differences between the gray scale values in the scaling generation is that the R, G and B gray scale values of the first pixels are increased as compared with those of the existing first pixels in data scaling based on the negative value, and therefore, the luminance of the first pixels may be increased. The increase in luminance may accelerate pixel degradation. Therefore, the negative value is excluded in order to prevent the pixel degradation.

In addition, the reason why the maximum value among the differences between the gray scale values is selected in the generation of the scaling variable is that when the change in the R, G and B gray scale values of the first pixels is too large, the decrease in the luminance of the first pixels becomes serious, and therefore, it is highly likely that the decrease in luminance may be recognized by a user.

Thus, in a case where the R, G and B gray scale values of the first pixels are corrected by performing the data scaling as described above, the R, G and B gray scales of the first pixels can be changed adaptively to the average gray scale value of the second pixels around the block while the ratio between the R, G and B of the pixels, corresponding to the logo, is maintained. Accordingly, it is possible to prevent the degradation and afterimage of the first pixels, corresponding to the logo, while minimizing the recognition of viewers.

That is, if the luminance of a logo is simultaneously changed when the luminance of a portion around the logo is changed, e.g., if a luminance ratio between the first and second pixels is maintained to be relatively constant, the user's eyes may not recognize the specific change in luminance in each of the first and second pixels. Thus, the R, G and B gray scale values of the first pixels are corrected using the average gray scale values of the respective R, G and B of the second pixels, so that it is possible to minimize the viewer's recognition of a change in the luminance of the logo.

According to an embodiment, the data correction unit 130 may correct the R, G and B gray scale values of the first pixels when the predetermined time is changed or when at least one of the average gray scale values of the respective R, G and B of the second pixels is changed.

According to another embodiment, the data correction unit 130 may generate a scaling variable, using the positive minimum value among the differences between the average gray scale values of the respective R, G and B of the first pixels and the average gray scale values of the respective R, G and B of the second pixels. In this case, the decrease in the luminance of the logo is larger than that in the case where the scaling variable is generated using the maximum value, and therefore, the viewer may be more likely to recognize a change in the luminance of the logo. However, as the luminance of the logo is relatively further decreased, the degradation of the pixel can be further delayed.

According to still another embodiment, the data correction unit 130 may correct the R, G and B gray scale values of the first pixels as complementary colors of the average gray scale values of the respective R, G and B of the second pixels. For example, if the average gray scale in the area around the logo is that of white, the gray scale of the logo may be changed into that of black which is the complementary color of white. If the average gray scale of the area around the logo is that of blue, the gray scale of the logo may be changed into that of red which is the complementary color of blue.

In this case, the logo is expressed to be contrasted with the color of the area around the logo, so that the image of the logo can be notable. Simultaneously, as the R, G and B gray scales of the area around the logo, i.e., the second pixels, are changed, the R, G and B gray scales of the logo, i.e., the first pixels, are also changed, so the R, G and B gray scales of the first pixels may emit the same colors for a reduced amount of time. Therefore, it is possible to prevent the afterimage and degradation of the pixels corresponding to the logo, i.e., in which the logo is positioned.

Figure 5:
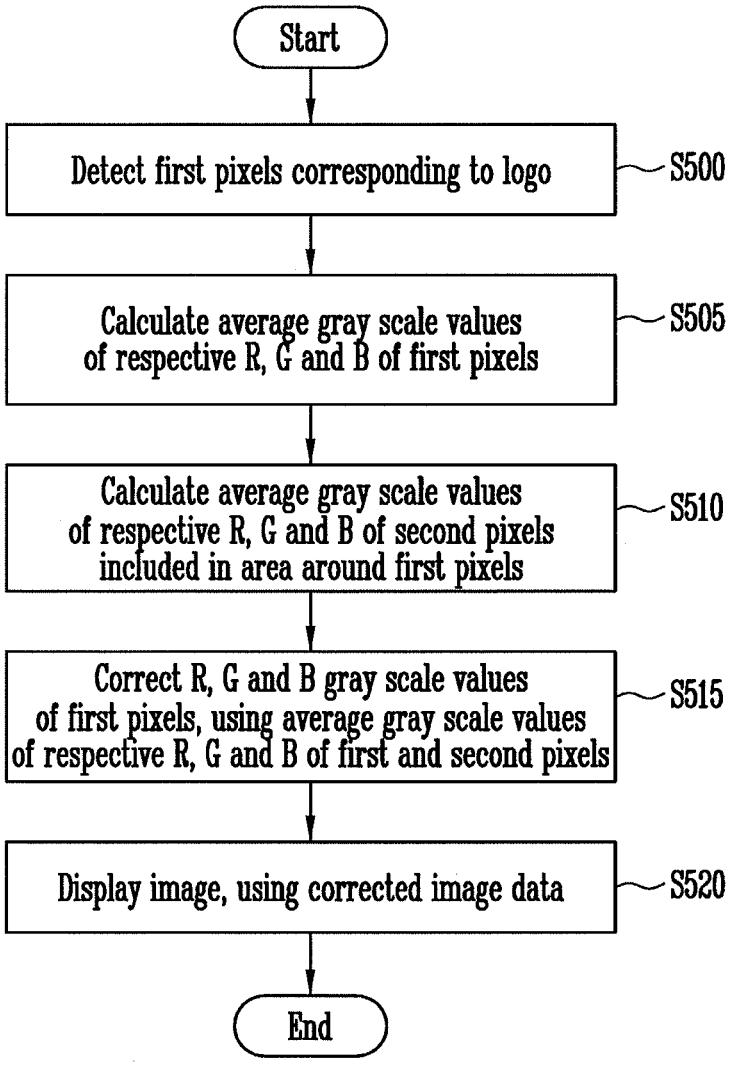
FIG. 5 illustrates a flowchart of a driving method of an organic light emitting display according to an embodiment.

FIG. 5 illustrates a flowchart of a driving method of the organic light emitting display according to an embodiment.

Referring to FIG. 5, in operation S500, the pixel detection unit 110 detects first pixels having the same R, G and B gray scale values for a predetermined time or more among the pixels 10, using an image data Data_i supplied from the outside of the image display device, in order to detect the first pixels corresponding to a logo. The logo may be generally included in a corner area of an image, and therefore, the pixel detection unit 110 may detect the first pixels with respect to the image data Data_i supplied to pixels included in the corner area among the pixels.

Subsequently, in operation S505, the gray scale value calculation unit 120 calculates average gray scale values of the respective R, G and B of the first pixels.

In operation S510, the gray scale value calculation unit 120 calculates average gray scale values of the respective R, G and B of the second pixels included in a predetermined area around the first pixels. To this end, the gray scale value calculation unit 120 may set a predetermined block around the first pixels, and may calculate the average gray scale values of the respective R, G and B of the second pixels except the first pixels included in the block.

Subsequently, in operation S515, the data correction unit 130 corrects, e.g., adjusts, the R, G and B gray scale values of the first pixels, using the average gray scale values of the respective R, G and B of the first pixels and the average gray scale values of the respective R, G and B of the second pixels. In detail, operation S515 may include generating a scaling variable, using the average gray scale values of the respective R, G and B of the first pixels and the average gray scale values of the respective R, G and B of the second pixels, and correcting the R, G and B gray scale values of the first pixels by multiplying the R, G and B gray scale values of the first pixels by the scaling variable.

Generating of the scaling variable may include calculating differences between the average gray scale values of the respective R, G and B of the first pixels and the average gray scale values of the respective R, G and B of the second pixels, and generating the scaling variable, using the positive maximum or minimum value among the differences between the gray scale values of the respective R, G and B. In this case, the scaling variable may refer to a value obtained by dividing the maximum or minimum value by the average gray scale value corresponding to the maximum or minimum value among the average gray scale values of the respective R, G and B of the first pixels.

Finally, in operation S520, the data driver 40 receives the corrected image data Data_o provided from the data correction unit 130, and supplies the received data Data_o to each pixel, thereby displaying an image in the image display unit.

The embodiment of the driving method of the image display device has been described. The configuration of the image display device described in FIGS. 2 and 3 can be applied to this embodiment. Its detailed description will be omitted.

By way of summation and review, according to embodiments, the gray scale values of pixels corresponding to a still image, e.g., a logo, may be corrected, e.g., continuously adjusted, in accordance with the gray scale values of pixels positioned around, e.g., immediately adjacent to, the logo. Therefore, it is possible to prevent or substantially minimize the occurrence of an afterimage and the degradation of the pixels corresponding to the still image, e.g., to the logo. Further, it is possible to minimize the viewer's recognition of a change in the luminance of the logo.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An image display device, comprising:

a plurality of pixels, each pixel including R, G, and B sub-pixels;

a pixel detector to detect a subset of the plurality of pixels as first pixels displaying a still image having constant R, G, and B gray scale values for a predetermined time corresponding a predetermined number of frames, the predetermined number being a natural number greater than one, using an image data supplied from an outside source of the image display device;

a gray scale value calculator to calculate average gray scale values of the respective R, G and B sub-pixels of the first pixels displaying the still image for the predetermined time and average gray scale values of corresponding R, G and B sub-pixels of second pixels, the second pixels being included in a predetermined area, the second pixels being adjacent to the first pixels and not displaying the still image, using the image data;

a data corrector to correct the R, G and B gray scale values of the first pixels included in the image data, using the calculated average gray scale values of the respective R, G and B sub-pixels of the first pixels and the average gray scale values of the corresponding R, G and B sub-pixels of the second pixels; and a data driver to receive the corrected R, G and B gray scale values of the first pixels, to generate corrected image data with the corrected R, G and B gray scale values of the first pixels, and to supply the corrected image data to each pixel of the plurality of pixels, wherein the data corrector is to generate a scaling variable, using the average gray scale values of the respective R, G and B sub-pixels of the first pixels and the average gray scale values of the corresponding R, G and B sub-pixels of the second pixels, and to correct the R, G and B gray scale values of the first pixels by multiplying the R, G and B gray scale values of the first pixels by the scaling variable, wherein the data corrector is to calculate a positive maximum or minimum value among differences between the average gray scale values of the respective R, G and B sub-pixels of the first pixels and the average gray scale values of the corresponding R, G and B sub-pixels of the second pixels, and wherein the data corrector is to generate the scaling variable by dividing the positive maximum or minimum value by an average gray scale value corresponding to the positive maximum or minimum value among the average gray scale values of the respective R, G and B sub-pixels of the first pixels.

2. The image display device as claimed in claim 1, wherein the data corrector is to correct the R, G and B gray scale values of the first pixels as complementary colors of the average gray scale values of the corresponding R, G and B sub-pixels of the second pixels.

3. The image display device as claimed in claim 1, wherein the data corrector is to correct the R, G and B gray scale values of the first pixels is changed or when at least one of the average gray scale values of the R, G and B sub-pixels of the second pixels is changed.

4. The image display device as claimed in claim 1, wherein the pixel detector is to detect the first pixels with respect to an image data supplied to pixels included in a corner area of a screen among the plurality of pixels.

5. A method of driving an image display device including a plurality of pixels, the method comprising:

detecting a subset of the plurality of pixels as first pixels displaying a still image having constant R, G and B gray scale values for a predetermined time corresponding a predetermined number of frames, the predetermined number being a natural number greater than one, using an image data supplied from an outside source of the image display device;

calculating average gray scale values of respective R, G and B sub-pixels of the first pixels displaying the still image for the predetermined time, using the image data;

calculating average gray scale values of the corresponding R, G and B sub-pixels of second pixels included in a predetermined area, the second pixels being adjacent to the first pixels and not displaying the still image;

correcting the R, G and B gray scale values of the first pixels included in the image data, using the average gray scale values of the respective R, G and B sub-pixels of the first pixels and the average gray scale values of the corresponding R, G and B sub-pixels of the second pixels; and receiving the corrected image data and supplying the received image data to each pixel, wherein correcting the R, G and B gray scale values of the first pixels includes:

generating a scaling variable, using the average gray scale values of the respective R, G and B sub-pixels of the first pixels and the average gray scale values of the corresponding R, G and B sub-pixels of the second pixels; and correcting the R, G and B gray scale values of the first pixels by multiplying the R, G and B gray scale values of the first pixels by the scaling variable, wherein generating the scaling variable includes:

calculating a positive maximum or minimum value among differences between the average gray scale values of the respective R, G and B sub-pixels of the first pixels and the average gray scale values of the corresponding R, G and B sub-pixels of the second pixels, and wherein the scaling variable is a value obtained by dividing the positive maximum or minimum value by an average gray scale value corresponding to the positive maximum or minimum value among the average gray scale values of the respective R, G and B sub-pixels of the first pixels.

6. The method as claimed in claim 5, wherein detecting the first pixels includes detecting the first pixels with respect to an image data supplied to pixels included in a corner area of a screen among the plurality of pixels.

7. The method as claimed in claim 5, wherein correcting the R, G and B gray scale values of the first pixels includes correcting the R, G and B gray scale values of the first pixels when a predetermined time is changed or when at least one of the average gray scale values of the R, G and B sub-pixels of the second pixels is changed.

8. The image display device as claimed in claim 1, wherein the second pixels display images having varying R, G, and B gray scale values for the predetermined time corresponding the predetermined number of frames.

* * * * *